United States Patent [19]

Grigorenko et al.

[11] 4,122,293

[45] Oct. 24, 1978

[54] FEED SYSTEM FOR PLASMA-ARC FURNACE

[76] Inventors: Georgy Mikhailovich Grigorenko, ulitsa Frolovskaya, 1, kv. 5; Ivan Vasilievich Sheiko, ulitsa Schuseva, 36, kv. 52, both of Kiev; Konstantin Sergeevich Eltsov, ulitsa 40 let Sovetskoi Ukrainy, 6, kv. 7, Zaporozhie; Albert Nikitovich Korotkov, prospekt Lenina, 228, kv. 2, Zaporozhie; Alexei Ivanovich Pakhomov, ulitsa Pravdy, 25, kv. 48, Zaporozhie; Sergei Arsentievich Kanibolotsky, ulitsa Rizhskaya, 69, kv. 1, Kiev; Viktor Iosifovich Lakomsky, ulitsa Tbilisskaya, 21, kv. 32, Zaporozhie; Vladimir Denisovich Shevchenko, ulitsa Latinskaya, 17, kv. 120, Zaporozhie; Nikolai Mikhailovich Kiselev, pereulok Zhdanova, 30, Zaporozhie; Gennady Fedorovich Torkhov, ulitsa Dobrokhotova, 28, kv. 6, Kiev, all of U.S.S.R.

[21] Appl. No.: 788,764

[22] Filed: Apr. 19, 1977

[51] Int. Cl.[2] ..... H05H 1/26

[52] U.S. Cl. ..... 13/2 P

[58] Field of Search ..... 13/1, 2 P, 2 R, 9 R, 13/33, 18

[56] References Cited

U.S. PATENT DOCUMENTS

| | | | |
|---|---|---|---|
| 3,130,292 | 4/1964 | Gage et al. | 13/9 X |
| 3,723,630 | 3/1973 | Paton et al. | 13/1 |
| 3,771,585 | 11/1973 | Ulrich | 13/9 |
| 3,940,551 | 2/1976 | Ling et al. | 13/9 R |
| 4,017,672 | 4/1977 | Paton et al. | 13/2 P |

*Primary Examiner*—R. N. Envall, Jr.

*Attorney, Agent, or Firm*—Lackenbach, Lilling & Siegel

[57] ABSTRACT

According to the invention, there is proposed a feed system for a plasma-arc furnace wherein an electrode with an axial opening is used as the low-temperature plasma generating means. The feed system comprises a gas conduit, in the form of an individual water-cooled member, a current-conducting element mounted within a shell and secured to a flange which includes a duct for the delivery of gas, a duct for feeding flux, and a duct for supplying water. The flange has secured to it the shell. A flux delivery means and a bus for power supply are also included. The herein proposed feed system makes it possible to assure stable operating conditions of a plasma-arc furnace, enhance its efficiency, reduce power losses and decrease expenses involved in the remelting of metals and alloys.

7 Claims, 2 Drawing Figures

FEED SYSTEM FOR PLASMA-ARC FURNACE

FIELD OF THE INVENTION

The present invention relates to metallurgy and, more particularly, to plasma-arc furnace feed systems.

The invention is best suited to adaptation in plasma-arc furnaces.

DESCRIPTION OF THE PRIOR ART BACKGROUND OF THE INVENTION

For example, there is known in the art a feed system for a plasmarc furnace comprising an electrode and a gas conduit coaxially aligned with the electrode. The gas conduit is in the form of a hollow metal cylinder and the electrode is secured to its lower end. The plasmarc furnace feed system referred to above is likewise equipped with a means for the delivery of flux to the melting zone. The flux delivery may be carried out both intermittently and continuously. A fixing assembly for coupling the electrode to the gas conduit, which is made in the form of two connecting pieces and a clamping ring, is also included.

The aforesaid feed system enables gas and flux to be fed to the melting zone through the interior of the gas conduit and that of the electrode. Electric current is supplied to the electrode through the gas conduit.

However, the known feed system sulfers from substantial power losses due to the absence of reliable means for conducting electric current to the electrode. Since the gas conduit is not cooled, it wears out or becomes inoperative in a relatively short period of time due to the sharp drop in temperatures, namely: in the liquidus temperature during melting and the ambient temperature during the furnace charging.

The fixing assembly used for coupling the electrode to the gas conduit does not ensure tightly sealed connection between the electrode and the gas conduit, because of the fact that the components of the fixing assembly are heated in the course of melting.

SUMMARY OF THE INVENTION

It is therefore an object of the invention to provide a reliable supply of power to a plasma-arc furnace electrode and cooling of the feed system components.

Another object of the invention is to ensure a reliable tightly sealed connection between an electrode and a gas conduit.

These and other objects and features of the invention are accomplished by a plasma-arc feed system comprising a gas conduit coaxially aligned with a plasmarc furnace electrode; a fixing assembly, for coupling the electrode to the gas conduit, made as two connecting pieces and a clamping ring; and a means for delivery flux to a melting zone. According to the invention, there is provided a current-conducting element in the form of a hollow cylinder coaxially aligned with the gas conduit and a shell housing the current-conducting element and the gas conduit. The feed system is additionally provided with a flange having secured thereto said shell and the flux delivery means. The flange is formed with ducts for the delivery of gas and water and a duct for the delivery of flux.

It is preferable that the length of the gas conduit should exceed that of the shell by an amount less than twice the diameter of said conduit.

It is preferable that the fixing assembly for coupling the electrode to the gas conduit be provided with a diaphragm, in the form of a thin-walled frustoconical member arranged within connecting pieces intermediate the shell and the electrode, and with seals, one seal being disposed between the shell and the diaphragm, and another seal being disposed between the electrode and the diaphragm.

The herein proposed plasmarc furnace feed system assures stable operating conditions of a plasma-arc furnace and reduces expenses involved in the remelting of metals and alloys.

BRIEF DESCRIPTION OF THE INVENTION

The invention will now be explained in greater detail with reference to embodiments thereof which are represented in the accompanying drawings. In the drawings:

FIG. 1 is a longitudinal section view of a plasmarc furnace feed system, according to the invention; and FIG. 2 is an enlarged, longitudinal section view of a part of a fixing assembly for connecting an electrode to a gas conduit, according to the invention.

DETAILED DESCRIPTION OF THE INVENTION

Figure 1:
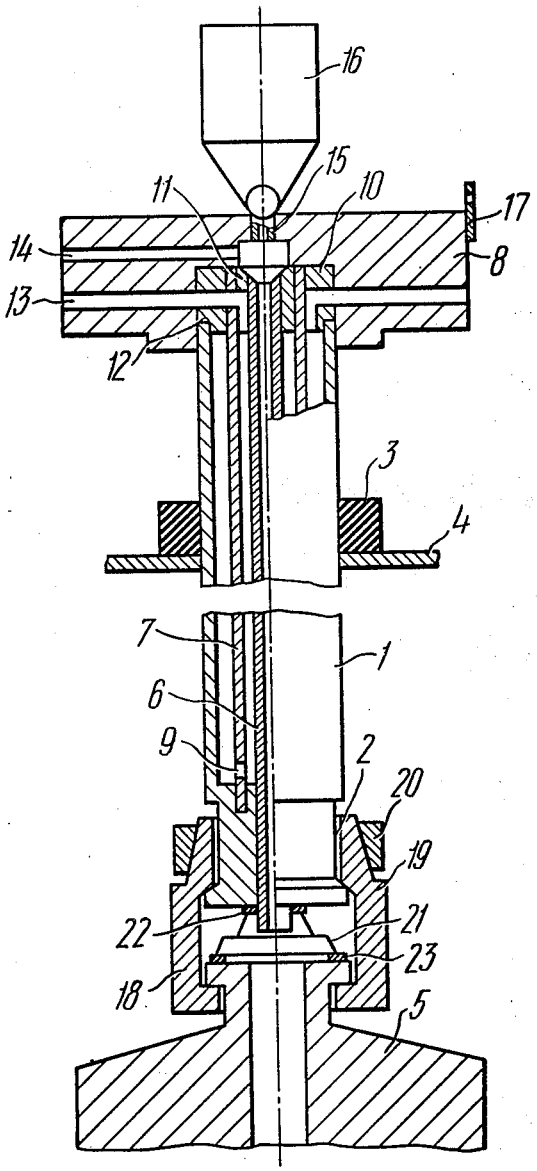
Figure 2:
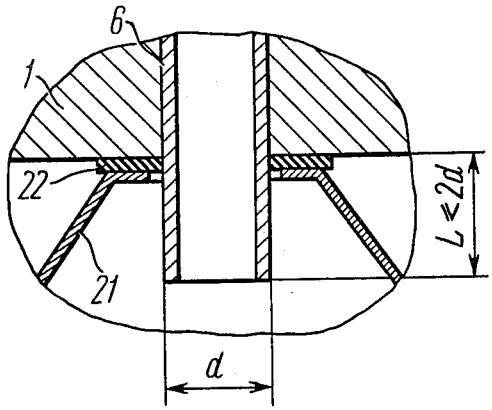

Referring now to the drawings and to FIG. 1 in particular, there is illustrated a feed system for a plasma-arc furnace, which comprises a shell 1 in the form of a hollow cylinder formed with a journal 2 in its lower end. The shell 1 is received with a seal 3 in a furnace melting chamber 4. An electrode 5 is affixed on the journal portion 2. Arranged coaxially with the shell 1 is a gas conduit 6 in the form of an individual water-cooled member. Arranged or located intermediate the gas conduit 6 and the shell 1 is a current-conducting element 7 in the form of a hollow cylinder coaxially aligned with the gas conduit 6. The upper end of the current-conducting element 7 is in firm contact with a flange 8, the lower end of said element 7 being in contact with the shell 1. The lower portion of the current-conducting element 7 is formed with circumferentially arranged openings 9 which ensure reliable cooling of the shell 1. The gas conduit 6, the current-conducting element 7 and the shell 1 are fixed to the flange 8 by means of a socket 10 and a sleeve 11. The socket 10 is made in the form of a hollow cylinder fitted with a journal 12 for mounting the shell 1. The flange 8 is formed with a duct 13 for the supply of water coolant, a duct 14 for the delivery of gas and a duct 15 for feeding flux. Secured to the flange 8 is a flux delivery means 16 and a bus 17 for power supply. The fixing assembly for the electrode-gas conduit connection consists of two connecting pieces 18 and 19 fitted on the shell 1 and on the electrode 5 and a clamping ring 20 strengthening the connecting pieces 18 and 19. The fixing assembly also incorporates an elastic diaphragm 21 in the form of a thin-walled frustoconical stepped member arranged or located between the connecting pieces 18 and 19 and between the shell 1 and the electrode 5. Disposed in the interspace between the diaphragm 21 and the shell 1 is a seal 22 and between the diaphragm 21 and the electrode 5 is a seal 23. The gas conduit 6 (see FIG. 2) extends beyond the lower end of the shell 1 a distance which does not exceed twice the diameter d of the gas conduit 6, thereby providing for a reliable tightly sealed connection between the electrode 5 and the gas conduit 6.

The herein proposed plasmarc furnace feed system operates in the following manner.

Prior to the melting operation, the electrode 5 (see FIG. 1), serving as a low-temperature plasma generating means, is fixedly attached to the gas conduit 6 in the following order. Placed on the top face of the electrode 5 is the seal 23 upon which the elastic diaphragm 21 is mounted in coaxial alignement with the electrode 5. Fitted on the end of the gas conduit 6, projecting beyond the shell 1, is the seal 22. The clamping ring 20 is mounted on the shell 1. Thereafter, the electrode 5 is linked up with the gas conduit 6 through the elastic diaphragm 21. The connecting pieces 18 and 19 are affixed on the journal 2 of the shell 1 so that said pieces grip the electrode 5. The clamping ring 20 is mounted on the connecting pieces 18 and 19 which are clamped tight by the action of the ring clamping force. In turn, the connecting pieces 18 and 19, moving along the tapered, journalled portion of the shell 1, draw the electrode 5 towards to the gas conduit 6. Reliable sealed connection between the electrode 5 and the gas conduit 6 is thus effected, due to the deformation of the elastic diaphragm 21. The portion of the gas conduit 6 (see FIG. 2), projecting beyond the lower part of the shell 1 by an amount not exceeding twice the of the gas conduit 6, enables reliable sealed connection to be effected between the electrode 5 (FIG. 1) and the gas conduit 6 by means of the fixing assembly. The projecting end of the gas conduit 6 should not extend beyond the limit indicated above as it may burn off towards the end of the melting process. The flux delivery means 16 is charged with ganular flux. After the melting chamber 4 is sealed and evacuated, it is then filled with gas of a requisite composition delivered thereinto through the duct 14 and the gas conduit 6. Electric power required to excite high-voltage plasma discharge is supplied to the electrode 5 through the bus 17, the flange 8, the current-conducting element 7, the lower part of the shell 1 and connecting pieces 18 and 19. As the electrode 5 burns off, it is lowered by shifting the feed system. Throughout the melting process all components of the feed system are cooled with water delivered to the feed system via the duct 13 provided in the flange 8 and the socket 10. In the course of melting, a flow of plasma-forming gas is delivered through the duct 14 and the gas conduit 6 and flux is fed with the aid of the delivery means 16 through the duct 15 and the gas conduit 6. On termination of the melting process, the power supply, as well as the delivery of gas and flux, is discontinued, the melting chamber 4 is depressurized and the stub-end of the electrode 5 is taken off. To disconnect the electrode 5 from the gas conduit 6, it is necessary to lift the clamping ring 20 and remove the connecting pieces 18 and 19, thus releasing the end stub of the electrode 5.

The herein proposed feed system for a plasma-arc furnace is simple in construction and easy in operation and maintenance; it also permits an enhancement of the furnace efficiency, provides for stable operating conditions and reduces the power losses.

What is claimed is:

1. A feed system for a plasma-arc furnace provided with an electrode having an axial opening and used as the low-temperature plasma generating means, said feed system comprising:

a gas conduit coaxially aligned with said electrode;

a current-conducting element coaxially aligned with said gas conduit;

a shell housing said current-conducting element and said gas conduit;

a fixing assembly for coupling said electrode to said gas conduit, said fixing assembly including two connecting pieces and a clamping ring, said connecting pieces being fitted around said shell and said electrode, and said clamping ring being secured around said connecting pieces;

a means for the delivery of flux to a melting zone of said plasma-arc furnace;

a flange having secured to it said shell and said flux delivery means, said flange having a duct for delivering gas, a duct for supplying water and a duct for feeding flux.

2. A plasma-arc furnace feed system as claimed in claim 1, wherein the length of said gas conduit exceeds that of said shell by an amount less than twice the diameter of said gas conduit.

3. A plasma-arc furnace feed system as claimed in claim 5, wherein said fixing assembly is provided with a diaphragm and seals, said diaphragm being arranged between said connecting pieces intermediate of said shell and said electrode, one of said seals being disposed in an interspace between said shell and said diaphragm, and another of said seals being disposed between said electrode and said diaphragm.

4. A plasma-arc furnace feed system as claimed in claim 2, wherein said fixing assembly is provided with a diaphragm and seals, said diaphragm being arranged between said connecting pieces intermediate of said shell and said electrode, one of said seals being disposed in an interspace between said shell and said electrode, and another of said seals being disposed between said electrode and said diaphragm.

5. A plasma-arc furnace feed system according to claim 1, wherein said current-conducting element is a hollow cylinder.

6. A plasma-arc furnace feed system according to claim 3, wherein said diaphragm is a thin-walled frustoconical member.

7. A plasma-arc furnace feed system according to claim 4, wherein said diaphragm is a thin-walled frustoconical member.

* * * * *